US005179914A

United States Patent [19]

Moore, Jr. et al.

[11] Patent Number: 5,179,914

[45] Date of Patent: Jan. 19, 1993

[54] FORCED DRAFT WATER HEATER WITH AN IMPROVED TANK STRUCTURE AND A METHOD FOR MAKING WATER HEATERS

[75] Inventors: Henry J. Moore, Jr., Playa del Rey; Bijan Gidanian, Granada Hills; Myron E. Deneau, Santa Monica, all of Calif.

[73] Assignee: Mor-Flo Industries, Inc., Cleveland, Ohio

[21] Appl. No.: 784,887

[22] Filed: Oct. 30, 1991

Related U.S. Application Data

[63] Continuation-in-part of Ser. No. 767,413, Sep. 30, 1991.

[51] Int. Cl.[5] ..... F22B 5/00

[52] U.S. Cl. ..... 122/17; 122/13.1; 122/14; 122/19; 126/361; 29/890.051

[58] Field of Search ..... 122/13.1, 17, 18, 19, 122/14; 126/361; 29/890.051

[56] References Cited

U.S. PATENT DOCUMENTS 4,637,347 1/1987 Troy ..... 122/13.1 X 4,641,631 2/1987 Jatana ..... 122/17 X 4,969,420 11/1990 McKeon ..... 122/17

4,974,551 12/1990 Nelson ..... 122/13.1 X

OTHER PUBLICATIONS

Poly Glass Residential/Light Commercial Water Treatment Pressure Vessels, advertising bulletin. Structural Fibers, An ESSEF Company, believed dated Mar. 1988.

Richmond Optima Innovative, High Performance, Non-Metallic Water Heater, advertising bulletin. Richmond Water Heater, dated Mar. 1988.

Marathon Electric Water Heaters, advertising bulletin. Marathon Water Heater Company, dated Feb. 1990.

*Primary Examiner*—Edward G. Favors

*Attorney, Agent, or Firm*—Body, Vickers & Daniels

[57] ABSTRACT

A fuel fired, high capacity, high efficiency water heater uses a cylindrical plastic tank. The strength of the plastic tank is maintained by keeping the side wall imperforate and providing all access to the interior through metallic top and bottom plates.

18 Claims, 3 Drawing Sheets

FORCED DRAFT WATER HEATER WITH AN IMPROVED TANK STRUCTURE AND A METHOD FOR MAKING WATER HEATERS

This application is a continuation-in-part of application Ser. No. 767,413 filed on Sep. 30, 1991 to Henry Jack Moore, Jr. and Myron E. Deneau.

The present invention pertains to the art of water heaters and more particularly to an overall structure for a water heater. The invention is particularly applicable to large capacity water heaters usable in commercial systems, combined water and space heating systems for residences and other high demand applications and will be described with particular reference thereto, although it will appreciated that the invention has broader applications.

INCORPORATION BY REFERENCE

Cameron et al U.S. Pat. No. 4,766,883 which issued Aug. 30, 1988 and Osborne et al U.S. Pat No. 5,022,352 are incorporated herein by reference and are to be considered as forming a part hereof.

BACKGROUND

Water heating and/or space heating appliances use heat created by a burner in a combustion chamber and transfer this heat to a fluid to be heated. Systems for accomplishing this task are described in U.S. Pat. No. 5,022,352 and U.S. Pat. No. 4,766,883 referred to above. These patents describe the workings of the burner and mechanical elements supporting the burner which create heat in the combustion chamber. The combustion chamber is surrounded by a body of water, which is contained within a closed tank which is in turn surrounded by a body of insulation. The products of combustion created in the combustion chamber exit the combustion chamber and pass through a helical tube of several turns within the body of water. The heat of combustion warms the walls of the combustion chamber and the helical tube. This heat is transferred to the water contained within the surrounding tank. The heated water from the water heater may also be used to heat the air of a home or building by piping the hot water to a heat exchanger designed for that purpose. The systems described in both U.S. Pat. Nos. 4,766,883 and 5,022,352 use a metallic water containing tank. Use of metallic tanks is conventional in water heaters. The tank is normally constructed of several pieces, including a cylindrical side wall, a top and a bottom. Holes are cut into the tank where access is required and fittings welded into the tank so that hot water outlet tubes, cold water inlet tubes, thermostats and the like can be accommodated and the access points sealed.

Such metallic tank structures have posed numerous problems in the past. If conventional steel is used, a coating must be applied to the interior of the tank to prevent corrosion. Where welds, fittings and joints are present, maintenance of integrity of an interior coating is difficult. Breaks or blemishes in the interior coating allow corrosion, which further compromises the coating and can lead to failure of the tank. One means of addressing this problem is the use of stainless steel; however, stainless steel is very expensive. Moreover, stainless steel must still be welded to provide fittings for the admission of inlets, outlets and sensors. The chemistry of weld metal is not always precisely controllable and corrosion susceptible areas can result. Corrosion resulting in a leak in a stainless steel tank, even if minuscule, normally results in total loss of the appliance. The leak is usually not discovered until it has allowed leaking fluid to destroy other elements of the structure.

It must be remembered that water heaters are mass produced products for sale in an extremely price competitive marketplace. A solution to a problem is not a real solution unless it can be implemented in a production line for large quantities of products. Moreover, it must be capable of uniform application in a mass production facility. The present inventions contemplates a new and improved tank structure which overcomes the above-referred to problems and others and provides a water heater of high efficiency, reliability, stability and quality. Moreover, the present invention provides a method of manufacturing such water heaters particularly useful in the mass production of commercial products.

SUMMARY OF THE INVENTION

In accordance with the present invention, there is provided a water heater construction comprising a bottom plate upon which a combustion chamber containing a burner is mounted, a top plate upon which sensors and a hot water outlet are mounted and a non-metallic tank body which is imperforate except for apertures receiving the top plate and bottom plate.

Further in accordance with the invention, the combustion chamber and the exhaust gas exit tube conducting the products of combustion from the combustion chamber, through the body of water contained within the tank and out of the tank are mounted on the bottom plate.

Yet further in accordance with the invention, the combustion chamber and exhaust gas exit tube assembly have a maximum horizontal cross section smaller than the cross section of the aperture in the tank receiving the bottom plate.

Still further in accordance with the invention, the top plate includes only a float switch, temperature and pressure relief valve, water temperature sensor and hot water outlet.

Still further in accordance with the invention, the top plate and bottom plate are bolted to the non-metallic tank whereby a modular assembly is provided allowing for the repair of individual elements should such be necessary.

Yet further in accordance with the invention, the top and bottom plate are constructed from one half inch (12.7 mm) thick plates of stainless steel.

Yet further in accordance with the invention, a method of manufacturing a water heater is provided in which individual modules are separately fabricated and finally assembled. Such modules including a top plate module, a bottom plate module and a non-metallic tank module. The bottom plate module including the combustion chamber, exhaust has exit tube, cold water inlet and burner assembly which can all be assembled to the bottom plate outside of the tank.

The primary object of the present invention is to provide a water heater having all the advantages of stainless steel construction of the working parts without the expense of the stainless steel tank.

It is another object of the present invention to provide a method of manufacturing water heaters in which the complex burner and combustion chamber assembly can be fabricated in an exposed position and safely loaded within a finished tank structure in a final assembly procedure.

It is yet another object of the present invention to provide a water heater in which there is no direct mechanical connection between the top plate module parts and the bottom plate module parts whereby alignment problems in final assembly are avoided.

It is still another object of the present invention to provide a complete water heater structure which is economical to manufacture an results in a water heater of superior performance, durability and uniformity of characteristics.

Further objects and advantages of the invention will become apparent from the following detailed description of the preferred embodiment of the invention and from the accompanying drawings.

BRIEF DESCRIPTION OF THE DRAWINGS

The invention may take physical form in certain parts and arrangements of parts, a preferred embodiment of which will be described in detail and illustrated in the accompanying drawings which form a part hereof and wherein.

DESCRIPTION OF THE PREFERRED EMBODIMENT

Figure 1:
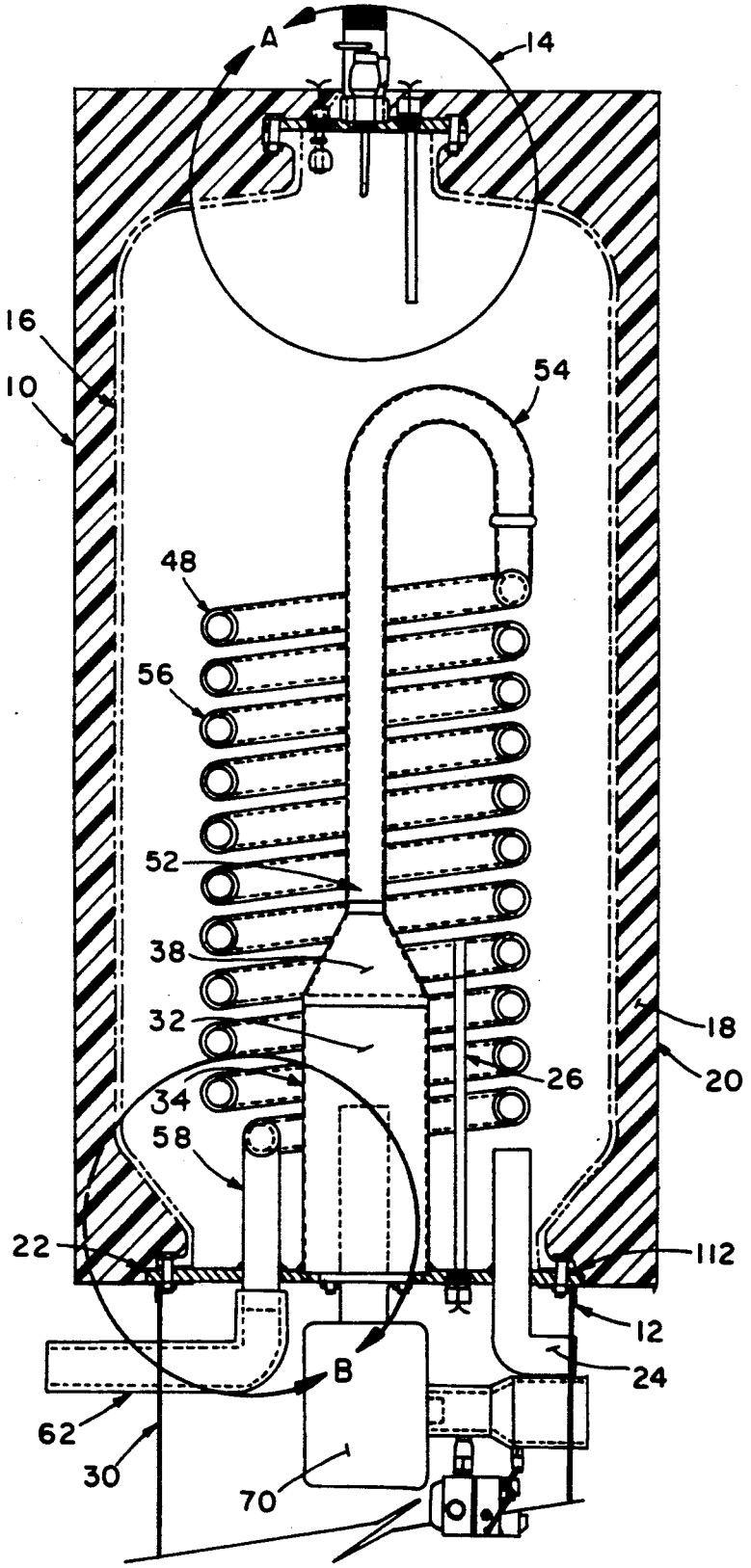
FIG. 1 is a side elevation of a water heater in accordance with the present invention showing the burner assembly schematically and the tank assembly in cross section.
Figure 3:
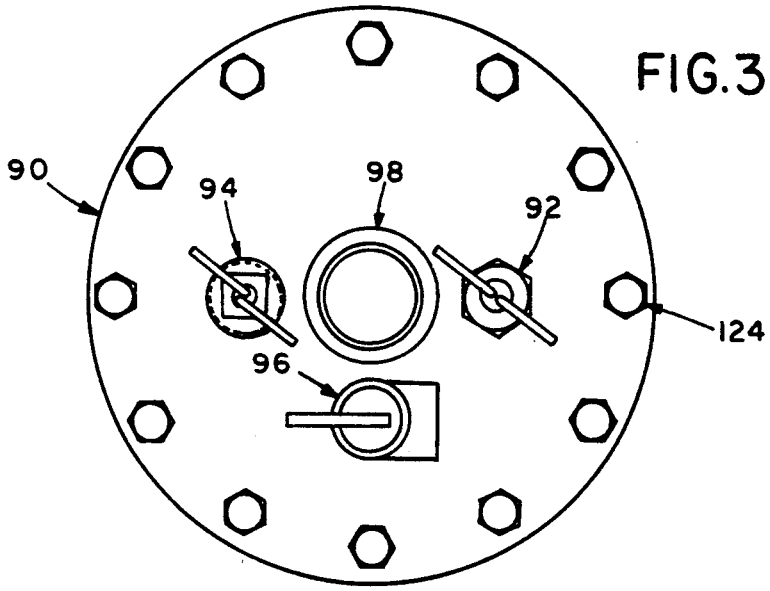
FIG. 3 is a plan view looking downwardly, of the top plate.
Figure 2:
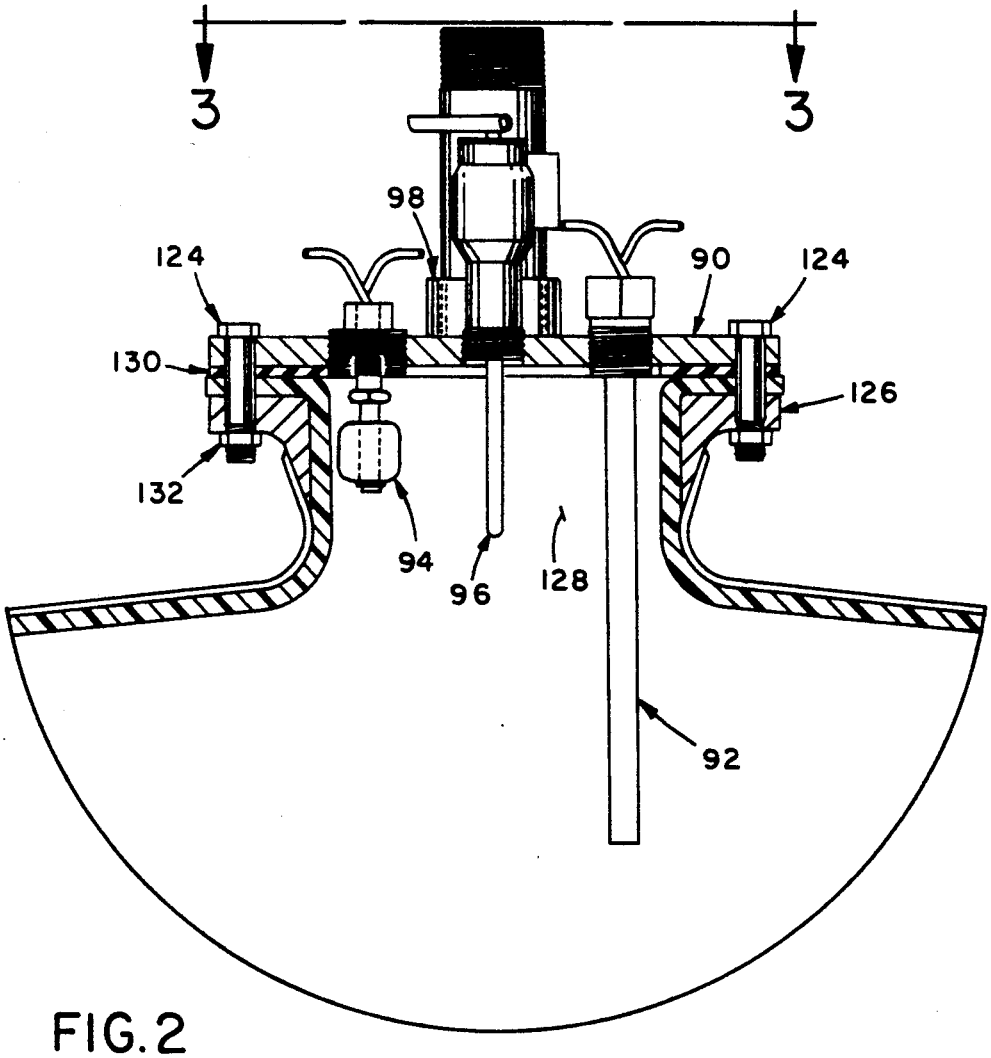
FIG. 2 is an enlarged cross sectional view of the area marked "A" in FIG. 1 showing the top plate assembly.

Referring now to the drawings, wherein the showings are for the purposes of illustrating a preferred embodiment of the invention only and not for purposes of limiting same, FIG. 1 shows a water heater 10 comprised of a bottom plate and combustion chamber assembly 12, a top plate assembly 14 and a tank 16. The tank 16 is surrounded by a body of insulation 18 which is in turn surrounded by an exterior jacket 20.

Figure 4:
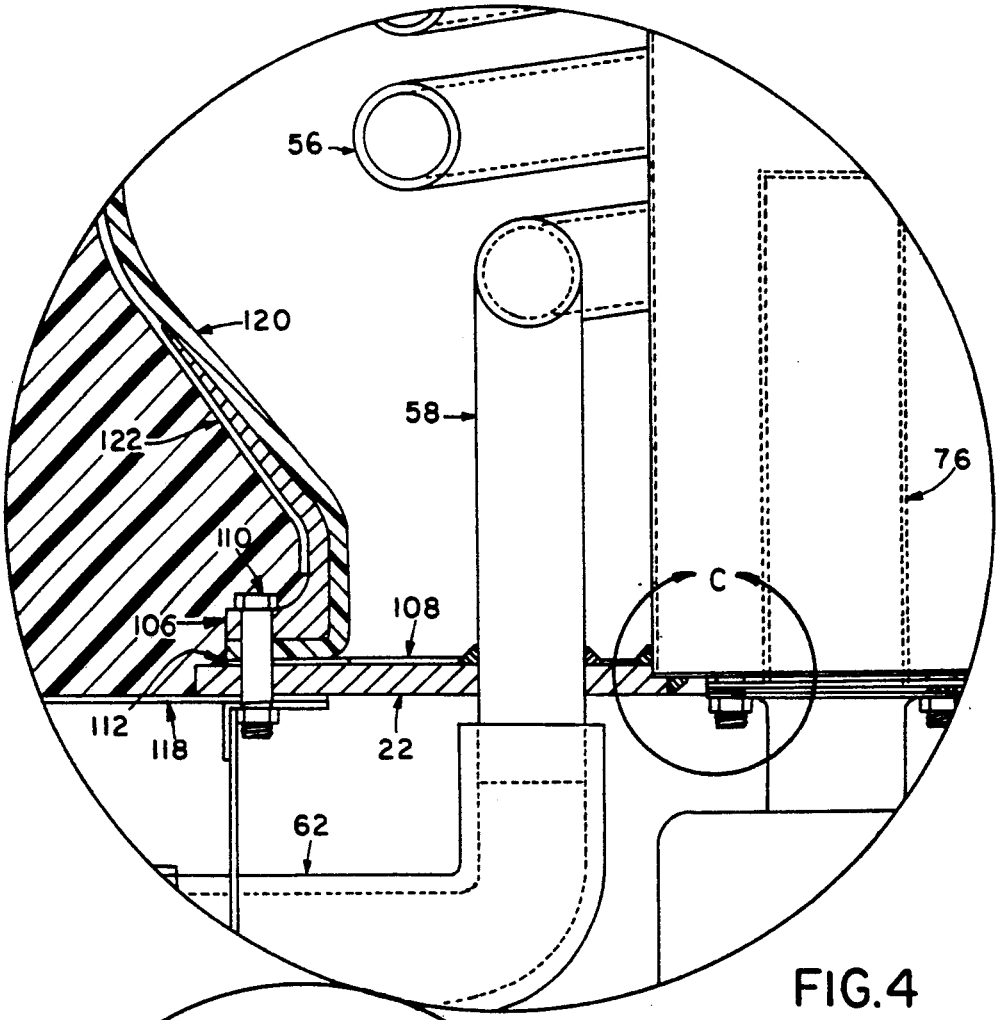
FIG. 4 is an enlarged cross sectional view of the area marked "B" in FIG. 1 showing a portion of the bottom plate assembly in detail; and, FIG. 5 is a cross sectional view of the portion marked "C" in FIG. 4 showing enlarged detail.

The bottom plate and combustion chamber assembly 12 include bottom plates 22 best seen in FIGS. 1 and 4. The bottom plate 22 is a substantially circular disk of stainless steel having a number of apertures allowing passage of the other portions of the bottom plate and combustion chamber assembly 12. The bottom plate 22 is one half inch (12.7 mm) thick. A cold water inlet 24 is formed from a short L-shaped length of stainless steel tubing which is welded into an aperture in the bottom plate 22. The cold water inlet extends only a short distance above the bottom plate and admits cold water to the bottom of the tank 16 when required. The cold water inlet tube is located directly under the coil tubing 56 which acts as a deflector to direct the incoming cold water evenly across the bottom of the tank. This promotes distribution of cold water throughout the bottom of the tank for uniform heating. The other end of the cold water inlet 24 passes through the base 30 for connection to the external water system. A lower water temperature and ECO sensor 26 is threaded into an aperture in the bottom plate 22 so that the sensing end of the sensor can monitor water temperature near the combustion chamber.

Figure 5:
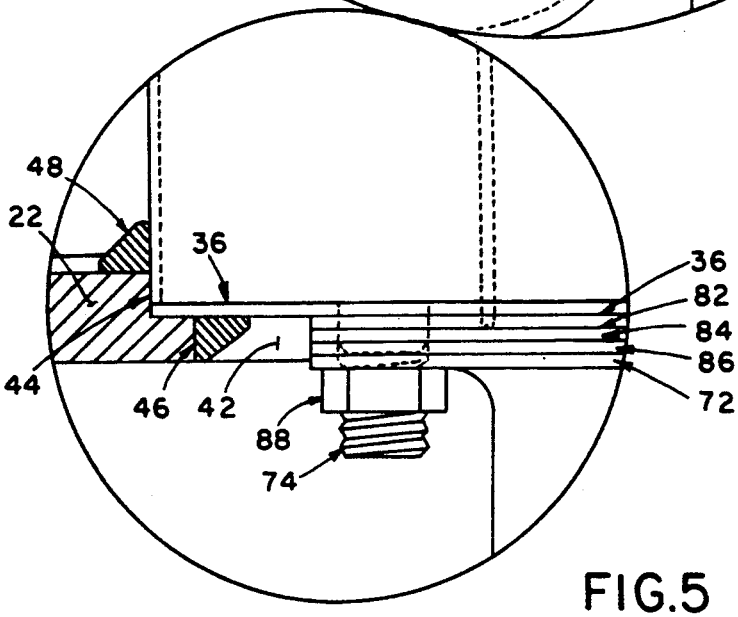

The combustion chamber 32 is surrounded by a cylindrical combustion chamber side wall 34, a combustion chamber bottom wall 36 and a combustion chamber top 38. As can be seen in FIGS. 4 and 5, the bottom plate 22 is provided with a circular opening 42 at or near its center. The circular opening 42 is surrounded by a circular recess 44 on the top surface of the bottom plate. As can be seen in FIG. 5, the combustion chamber bottom wall 36 fits snugly in the recess 44 and is welded to the bottom plate by means of a continuous weld 46 around the opening 42. The combustion chamber side wall 34 fits snugly in the recess 44 and is fixed in place by a continuous weld 48 at the top of the bottom plate 22. The combustion chamber top 38 is fixed to the combustion chamber side wall 34 by a weld around its periphery (not shown) and an exhaust gas exit tube 48 (FIG. 1) is fixed to the top of the combustion chamber top 38. The exhaust gas exit tube comprises a straight segment 52 generally aligned with the center of the water heater and conducting exhaust gases upwardly, a U-shaped segment 54, a helical coil segment 56, and a tank exit segment 58. The exhaust gas exit tube 48 is fabricated from stainless steel as are all of the combustion chamber walls. The exhaust gas exit tube can be fabricated from one or more segments of stainless steel tubing formed and welded together. The tank exit segment 58 passes through a circular opening in the bottom plate 22 and is welded to that opening around its periphery. A tail piece 62 is connected to the tank exit segment 58 by means of threads or the like and passes through an aperture in the base 30 where it is connected to plastic pipe or duct conducting the products of combustion to the outside atmosphere.

All of the above described elements which are connected to or pass through the bottom plate pass through in a water tight manner.

A fuel and air proportioner and blower 70 are positioned below the bottom plate 22. The structure of these elements and their operation are more fully described in U.S. Pat. No. 4,766,883 and U.S. Pat. No. 5,022,352 which have been incorporated herein by reference. These structures will not be described in detail herein. The blower output horn 72 is fixed to the bottom plate 22 by means of a plurality of studs 74 which are permanently fixed to the combustion chamber bottom wall 36. As can be best seen in FIG. 5, the studs 74 are spot welded or the like to the combustion chamber bottom wall 36. A number of these studs are placed around an opening in the combustion chamber bottom wall 36 through which mixed combustion gases are forced by the fuel and air proportioner and blower 70. A burner assembly 76 which extends into the combustion chamber 32 is also supported on the studs 74. As can best be seen in FIG. 5, a stack of layers on the studs provides an airtight seal. A gasket 82 is placed between the combustion chamber bottom wall 36 and the burner bottom flange 84. A second gasket 86 is placed between the burner bottom flange 84 and the blower horn 72. Nuts 88 on the studs 74 compress this stack and form an airtight seal between the blower output horn 72 and the combustion chamber 32.

The top plate assembly 14 is comprised of a one half inch (12.7 mm) thick stainless steel top plate disk 90 having threaded holes for passage of an upper water temperature sensor 92, a float switch 94 and a temperature and pressure relief valve 96. A collar 98 is affixed by welding or the like over an opening in the center of a top plate 90 and threaded on its inside. The collar acts as a hot water outlet for the water heater 10.

The tank 16 is comprised of an inner tank 120 and a layer of resin impregnated fiberglass 122 (FIG. 4). The inner tank 120 is molded from a polymer material such as polyethylene. It is rotationally molded in one piece. The resin impregnated fiberglass 122 is then wound on the inner tank 120 in a conventional manner. Tank bodies constructed in this manner are commercially available from Structural Fibers of Chardon, Ohio and others. The tank 16 is provided with a bottom flange 106 surrounding a bottom opening 108. The bottom flange 106 is a circular metal part molded into the tank 16. The bottom flange can be fabricated from other materials. The bottom opening 108 is circular and slightly larger than the outside diameter of the coil portion 56 of the exhaust gas exit tube 48. The flange 106 is provided with a plurality of bolt holes spaced around the periphery of the opening 108 through which several bolts 110 pass. The bolts 110 hold the bottom plate 22 and a gasket 112 against the flange 106 and seal the opening 108. The bolts also attach the base 30 supporting the entire water heater and enclosing the fuel and air proportioner and blower 70 as well as the bottom 118 of the outer jacket 20.

The tank 16 is also provided with a top opening 114 surrounded by a top flange 116. Several bolts 124 connect the top plate 90 to the tank 16 at a top flange 126 which surrounds a top opening 128. A gasket 130 is compressed between the flange 126 and the top plate 90 by several nuts 132 on bolts 124. The closure of the top opening 128 with the top plate 90 and the bottom opening 108 with the bottom plate 22 seals the tank 16 as the tank 16 has no other openings.

The fuel and air proportioner and blower are controlled by a thermostat which receives information from the float switch 94, the upper water temperature sensor 92 and the lower water temperature and ECO sensor 26. Such thermostatic control systems are available from several vendors, including Honeywell of Minneapolis, Minn. Published information is generally available in the trade on such control systems. In essence, the control systems turn the blower on and off and initiate combustion in response to low temperature readings at the lower water temperature and ECO sensor 26. When water temperature rises to a selected level, combustion is terminated. The upper water temperature sensor prevents overheating of the hotter water near the top of the water heater. The float switch prevents the water heater from operating when it is not filled with water and the ECO portion of the lower water temperature and ECO sensor 26 also acts as a safety cutoff for the system. These systems are generally available in the trade.

The above described structure provides advantages in the manufacture of a water heater. The cost and weight of the unit are both significantly lower than for a similar capacity prior art metal tank device. The polyethylene tank described herein is less expensive than a similar capacity stainless steel tank and significantly lighter. Savings in the cost of material are substantial. Savings in shipping costs are substantial. Additionally manufacturing costs are reduced because of the modularity of the design. The most complex and difficult portions of the water heater are all mounted upon the bottom plate 22. As the bottom plate 22 is a flat half inch thick stainless steel plate which can be set up in a jig and conveniently worked on, manufacturing problems are avoided. All welding can be performed in an optimum position and no interior welds within a tank are required. The single weld on the bottom of the plate can be performed first before any assembly operations are undertaken. The plate can be flipped over and all top welds made in the upright position. All welds are made overhand with minimal obstructions. After the welding steps are completed, the fuel and air proportioner 70 and lower water temperature and ECO sensor are mounted. The base 30, the jacket bottom 112 and the tank 16 are then bolted to the bottom plate. As previously noted, the bottom opening 108 in the tank 16 is large enough so that the tank may be easily slid over the assembled exhaust gas exit tube 56.

The top plate 90 is next assembled to the top flange 126. Importantly, none of the elements fixed to the top plate 90 extend downwardly to the level of the exhaust gas exit tube 48. There is no dip tube. There is no possibility of damaging elements of the water heater by striking top plate elements against bottom plate elements. Precast foam insulation 18 can be assembled to the tank 16 and the outer jacket 20 assembled, finishing the water heater 10. Alternatively, the rest of the jacket 20 can be assembled and foam insulation injected into the annular volume between the tank and the jacket 20 completing construction of the finished water heater.

Importantly, the tank 16 has no openings other than the top opening 128 and the bottom opening 108. The possibility of a tank leaking at a fitting is minimized. The tank strength is not compromised by openings in its main cylindrical surface.

The invention has been described with reference to a preferred embodiment. Obviously, modifications and alterations will occur to others upon the reading and understanding of the specification. It is intended to include all such modifications and alterations insofar as they come within the scope of the appended claims or the equivalence thereof.

Having thus described the invention, it is claimed:

1. A water heater comprising:

a generally cylindrical, non-metallic tank having a large bottom opening having a bottom opening minimum diameter, a top opening and an imperforate generally cylindrical side wall;

a body of insulation substantially surrounding said tank;

a metallic bottom plate adapted to close said tank bottom opening having an upwardly facing inside and a downwardly facing outside;

a metallic combustion chamber wall enclosing a combustion chamber fixed to said bottom plate;

a cold water inlet tube passing through and fixed to said bottom plate;

a products of combustion outlet passing through and fixed to said bottom plate;

bottom fixing means fixing said bottom plate to said tank closing said bottom opening;

a burner disposed within said combustion chamber;

a circular opening in said bottom plate disposed beneath said burner;

means supplying air and fuel to said burner;

means fixing said air and fuel supplying means to said bottom plate; and, exhaust means communicating said combustion chamber to said products of combustion outlet.

2. The water heater of claim 1 wherein said bottom plate, said combustion chamber wall, said cold water inlet tube and said products of combustion outlet are stainless steel.

3. The water heater of claim 1 wherein said combustion chamber wall, said cold water inlet tube and said products of combustion outlet are welded to said bottom plate.

4. The water heater of claim 1 wherein said exhaust means comprises an exhaust gas exit tube having a combustion chamber end fixed to said combustion chamber, a helical segment of several turns having a helical segment maximum horizontal diameter and a tank exit portion passing through said bottom plate, said helical segment maximum horizontal diameter being smaller than said bottom opening minimum diameter.

5. The water heater of claim 4 further comprising a metallic top plate adapted to close said tank top opening having a hot water outlet therein.

6. The water heater of claim 5 wherein the highest extending element mounted on said bottom plate extends less high than a first horizontal plane in said tank and said lowest extending element mounted on said top plate extends less low than said first horizontal plane whereby said top plate mounted elements cannot contact said bottom plate mounted elements.

7. The water heater of claim 4 wherein said bottom fixing means comprises a bottom flange about said bottom opening integral with said tank, a plurality of bolt holes in said bottom flange, a plurality of bolt holes in said bottom plate and fasteners pressing through said bottom flange bolt holes and said bottom plate bolt holes.

8. The water heater of claim 1 wherein said bottom plate further comprises a recess around said circular opening, and said water heater further comprises a combustion chamber bottom wall, said combustion chamber bottom wall being retained in said recess and welded to said bottom plate about the periphery of said circular opening, said metallic combustion chamber wall being received in said recess and welded to said bottom plate about the periphery of said recess.

9. A water heater comprising:

a non-metallic tank having a large bottom opening and a top opening and an imperforate generally cylindrical sidewall;

a body of insulation substantially surrounding said tank;

a metallic bottom plate adapted to close said tank bottom opening having a combustion chamber access opening, a cold water inlet opening and a products of combustion outlet opening;

a metallic top plate having a hot water outlet opening;

a combustion chamber enclosure enclosing a combustion chamber within said tank fixed to said bottom plate;

an exhaust gas exit tube connecting said combustion chamber to said products of combustion outlet opening;

10. The water heater of claim 9 wherein said bottom plate, said top plate, said combustion chamber wall, said cold water inlet and said products of combustion outlet are stainless steel.

11. The water heater of claim 9 wherein said combustion chamber wall, said cold water inlet tube and said products of combustion outlet are welded to said bottom plate.

12. The water heater of claim 9 wherein said exhaust means comprises an exhaust gas exit tube having a combustion chamber end fixed to said combustion chamber, a helical segment of several turns having a helical segment maximum horizontal diameter and a tank exit portion passing through said bottom plate, said helical segment maximum horizontal diameter being smaller than said bottom opening minimum diameter.

13. The water heater of claim 9 wherein the highest extending element mounted on said bottom plate extends less high than a first horizontal plane in said tank and said lowest extending element mounted on said top plate extends less low than said first horizontal plane whereby said top plate mounted elements cannot contact said bottom plate mounted elements.

14. The water heater of claim 9 wherein said bottom fixing means comprises a bottom flange about said bottom opening integral with said tank, a plurality of bolt holes in said bottom flange, a plurality of bolt holes in said bottom plate and fasteners pressing through said bottom flange bolt holes and said bottom plate bolt holes.

15. A method of constructing a water heater comprising:

providing a generally cylindrical, non-metallic tank having a large bottom opening and an imperforate side wall;

providing a metallic bottom plate adapted to close said tank bottom opening, said bottom plate having a combustion chamber access opening, a cold water inlet opening and a products of combustion outlet opening;

welding a combustion chamber wall having a combustion chamber outlet surrounding a combustion chamber to said bottom plate such that said combustion chamber access opening communicates with said combustion chamber;

providing a products of combustion conduit communicating said combustion chamber outlet to said bottom plate products of combustion outlet opening;

providing a blower and air/fuel proportioner assembly to said bottom plate such that said blower and air/fuel proportioner assembly communicates with said combustion chamber access opening;

providing a base, an outer jacket bottom, an outer jacket side wall and an outer jacket top;

providing thermal insulation adapted to surrounding said tank;

assembling said tank, said bottom plate, said outer jacket bottom,. said outer jacket side wall, said outer jacket top such that said tank bottom opening is closed and said insulation surrounds said tank.

16. The method of claim 15 wherein said insulation is precast foam insulation.

17. A method of constructing a water heater comprising:

providing a generally cylindrical non-metallic tank having a large bottom opening, a top opening and an imperforate, generally cylindrical side wall;

providing a metallic bottom plate adapted to close said tank bottom opening, said plate having a combustion chamber access opening, a cold water inlet opening and a products of combustion outlet opening;

welding a combustion chamber wall having a combustion chamber outlet surrounding a combustion chamber to said bottom plate such that said combustion chamber access opening communicates with said combustion chamber.

providing a products of combustion conduit communicating said combustion chamber outlet to said bottom plate products of combustion outlet opening;

providing a metallic top plate adapted to close said tank top opening, said top plate having a hot water outlet opening;

providing a blower and air/fuel proportioner assembly adapted to be mounted to said bottom plate such that said blower and air/fuel proportion assembly communicates with said combustion chamber access opening;

providing a base;

providing an outer jacket;

providing a body of thermal insulation adapted to surround said tank; and, assembly said tank said body of insulation, said bottom plate, said top plate, said outer jacket; said blower and air/fuel proportion assembly, such that said tank is water tightly sealed.

18. The method of claim 17 wherein said non-metallic tank is provided with a flange surrounding said bottom opening and a flange surrounding said top opening, said bottom plate is bolted to said flange surrounding said bottom opening and said top plate is bolted to said flange surrounding said top opening.

* * * * *